US007669695B2

(12) United States Patent
Hikita et al.

(10) Patent No.: US 7,669,695 B2
(45) Date of Patent: Mar. 2, 2010

(54) FIRE EVACUATION OPERATION SYSTEM FOR GROUP CONTROLLED ELEVATORS

(75) Inventors: Shiro Hikita, Tokyo (JP); Kiyoji Kawai, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 315 days.

(21) Appl. No.: 11/575,681

(22) PCT Filed: Sep. 5, 2005

(86) PCT No.: PCT/JP2005/016217

§ 371 (c)(1),
(2), (4) Date: Mar. 21, 2007

(87) PCT Pub. No.: WO2007/029301

PCT Pub. Date: Mar. 12, 2007

(65) Prior Publication Data

US 2007/0278044 A1 Dec. 6, 2007

(51) Int. Cl.
*B66B 1/20* (2006.01)

(52) U.S. Cl. ..... 187/284; 187/287; 187/313

(58) Field of Classification Search ..... 187/247, 187/248, 313, 316, 317, 380–388, 391–393
See application file for complete search history.

(56) References Cited

U.S. PATENT DOCUMENTS 4,023,146 A * 5/1977 Carroll ..... 710/113
5,979,607 A * 11/1999 Allen ..... 187/390
6,000,505 A * 12/1999 Allen ..... 187/391
7,182,174 B2 * 2/2007 Parrini et al. ..... 182/18
7,210,564 B2 * 5/2007 Kawai ..... 187/384
7,461,723 B2 * 12/2008 Kawai ..... 187/313
2006/0054420 A1 * 3/2006 Gordon et al. ..... 187/313

FOREIGN PATENT DOCUMENTS

| | | |
|---|---|---|
| JP | 56 3272 | 1/1981 |
| JP | 64 13387 | 1/1989 |
| JP | 5 8954 | 1/1993 |
| JP | 5 147849 | 6/1993 |
| JP | 2005 187162 | 7/2005 |

OTHER PUBLICATIONS

U.S. Appl. No. 12/519,176, filed Jun. 15, 2009, Kawai, et al.

* cited by examiner

*Primary Examiner*—Jonathan Salata
(74) *Attorney, Agent, or Firm*—Oblon, Spivak, McClelland, Maier & Neustadt, L.L.P.

(57) ABSTRACT

A fire evacuation operation system for group-controlled elevators that enables a large number of people to evacuate a building in a short time is provided. Safe elevators are provided for evacuation of the building according to the position of the floor on which the fire breaks out. The fire evacuation operation system includes an evacuation operation propriety judging unit that judges whether an evacuation operation is improper or possible, a rescue floor setting unit that sets a rescue floor, and an evacuation operation instruction unit that assists people who are present in the building to evacuate.

10 Claims, 6 Drawing Sheets

FIRE EVACUATION OPERATION SYSTEM FOR GROUP CONTROLLED ELEVATORS

TECHNICAL FIELD

The present invention relates to a fire evacuation operation system for group-controlled elevators capable of efficiently performing evacuation by using the elevators when a fire breaks out in a high-rise building.

BACKGROUND ART

In general, when a fire breaks out in a building, each elevator mostly travels to its nearest floor and operations after that are suspended. This is because mainly secondary disasters by elevators are to be prevented. That is, in a usual fire emergency return operation of an elevator, when a fire broke out, the elevator is caused to land nonstop at an evacuation floor of the elevator in order to rapidly evacuate passengers who are already in the elevator, and a door open condition is kept for a long time in order to prevent the passengers from being shut in, and after that, the use of elevators during the fire is prohibited thereby to prevent secondary disasters.

Incidentally, apart from a usual elevator, there is also an emergency elevator of special construction which firefighters and the like use during a fire.

In recent buildings, however, improvements have been made in fire protection partitions and other techniques and floors except a floor on which a fire broke out and floors above this floor in close vicinity thereto are little affected by the fire and elevators are allowed to continue their usual operations.

As an operation method of elevators in which this is taken into consideration, for example, during a fire in a high-rise building, a group of elevators which serves zones including a floor on which the fire broke out is caused to perform a fire emergency return operation (performing a nonstop travel to the nearest floor and making a stop), priorities are assigned to the zones, and fire emergency return operations are performed for each zone in order of priority. By adopting this operation method, the duration of a usual operation on a floor which is little affected by the fire is extended (refer to Patent Document 1, for example).

Also, for example, according to the information from fire detection means installed on each floor, passengers are guided to a floor which permits safe evacuation by avoiding a floor on which a fire broke out (refer to Patent Document 2, for example).

Patent Document 1: Japanese Patent Laid-Open No. 5-8954

Patent Document 2: Japanese Patent Laid-Open No. 5-147849

DISCLOSURE OF THE INVENTION

Problems to be Solved by the Invention

In the former conventional art, however, the duration of a usual operation is only extended a little for elevators which serve safe floors and usual elevators are not positively used or provided as evacuation means. Similarly, also in the latter conventional art, the evacuation floor is only changed according to a floor on which the fire broke out, and usual elevators are not positively used or provided as evacuation means.

The present invention has been made to solve problems as described above, and with attention paid to the fact that owing to improvements in fire protection partitions of buildings and other techniques or the like, floors except a floor on which a fire broke out and floors above this floor in close vicinity thereto are little affected by the fire, the invention provides a fire evacuation operation system for group-controlled elevators which permits the evacuation of a large number of people in a short time by positively providing safe elevators as evacuation means according to the position of the floor on which the fire broke out.

Means for Solving the Problems

A fire evacuation operation system for group-controlled elevators related to the present invention is one in which floors to be served are divided into multiple service zones, multiple elevators which serve each of the service zones from an entrance floor are provided, and each of the elevators is caused to stop at a nearest floor thereof when a fire detector installed on each floor of a building detected that a fire had broken out, comprising an evacuation operation propriety judging unit that judges, in the event of a fire breaking out, an evacuation operation is improper for an elevator which serves a zone including a floor on which the fire broke out and causes the elevator to stop at a nearest floor thereof and then to suspend an operation thereof, and judges that an evacuation operation is possible for an elevator which serves a zone not including the floor on which the fire broke out, a rescue floor setting unit that sets a rescue floor, according to the floor on which the fire broke out, for the elevator for which the evacuation operation propriety judging unit has judged that an evacuation operation is possible, and an evacuation operation instruction unit that assists people in a building to evacuate by causing the elevator to reciprocate between the entrance floor, which becomes the evacuation floor, and the rescue floor.

For a zone above the zone including the floor on which the fire broke out, the rescue floor setting unit sets a rescue floor on a transit floor between the relevant zone and a zone which is by one story lower than the relevant zone. And for a zone below the zone including the floor on which the fire broke out, the rescue floor setting unit sets a rescue floor on a transit floor between the relevant zone and a zone which is by one story higher than the relevant zone.

In a case where the floor on which the fire broke out is a transit floor between zones, the evacuation operation propriety judging unit suspends the operation of elevators in zones which share the relevant transit floor.

In a case where the floor on which the fire broke out is a floor which is below a transit floor between zones in close vicinity thereto, the rescue floor setting unit sets a rescue floor on a floor which is above the relevant transit floor in close vicinity thereto.

Also, a fire evacuation operation system for group-controlled elevators related to the present invention is one in which floors to be served are divided into multiple service zones, multiple elevators which serve each of the service zones from an entrance floor are provided, and each of the elevators is caused to stop at a nearest floor thereof when a fire detector installed on each floor of a building detected that a fire had broken out, comprising a fire-zone rescue floor setting unit that, in the event of a fire breaking out, causes all elevators to stop at a nearest floor thereof and thereafter sets a rescue floor, for each elevator in a zone including the floor on which the fire broke out, on a transit floor above the zone served by the relevant elevator or a transit floor below the zone served by the relevant elevator according to the position of the floor on which the fire broke out a nonfire-zone rescue floor setting unit that sets, for a zone above the zone including the floor on which the fire broke out, a rescue floor on a transit floor between the relevant zone and a zone which is by one floor lower than the relevant floor, and sets, for a zone below the zone including the floor on which the fire broke out, a rescue floor on a transit floor between the relevant zone and a zone which is by one floor higher than the relevant floor, and an evacuation operation instruction unit that assists people in a building to evacuate by causing all of the elevators to reciprocate between an entrance floor, which becomes the evacuation floor, and the rescue floor.

In a case where the floor on which the fire broke out is a top zone, the fire-zone rescue floor setting unit sets a rescue floor on a transit floor below the top zone as the rescue floor for an elevator which serves the top zone. In a case where the floor on which the fire broke out is not a top zone and the floor on which the fire broke out is above a zone including the floor, the fire-zone rescue floor setting unit sets a rescue floor on a transit floor above the relevant zone as the rescue floor for an elevator which serves the relevant zone. And in other cases, the fire-zone rescue floor setting unit sets a rescue floor on a transit floor below the relevant zone.

In a case where the floor on which the fire broke out is a transit floor between zones or a floor directly under the transit floor, the fire-zone rescue floor setting unit excludes the transit floor from candidates for rescue floors.

In a case where the floor on which the fire broke out is a transit floor between zones or a floor directly under the transit floor and the transit floor has been excluded from candidates for rescue floors and when there is another transit floor capable of being served, the fire-zone rescue floor setting unit sets a rescue floor on the relevant transit floor.

ADVANTAGES OF THE INVENTION

As described above, according to the present invention, even when a fire broke out in a high-rise building, by positively providing elevators as rescue means according to the position of the floor on which the fire broke out, people who are present in the building can evacuate by use of stairs and elevators in combination. Thus, the present invention has the advantage that a large number of people can evacuate in a short time.

For a zone above the zone including the floor on which the fire broke out, a rescue floor is set on a transit floor between the relevant zone and a zone which is by one story lower than the relevant floor, and for a zone below the zone including the floor on which the fire broke out, a rescue floor is set on a transit floor between the relevant zone and a zone which is by one story higher than the relevant floor, whereby it is possible to make fair and equitable the stair movement distance of the people who are present in the building and each elevator stops only at evacuation floors and rescue floors. Therefore, it is possible to accelerate the cycle time. Thus, the present invention has the advantage that a large number of people can evacuate in a short time.

The present invention has the advantage that in a case where the floor on which the fire broke out is a transit floor between zones, the operation of elevators in zones which share the relevant transit floor is suspended, whereby evacuation can be performed by using safe elevators.

The present invention has the advantage that in a case where the floor on which the fire broke out is a floor which is below a transit floor between zones in close vicinity thereto, by setting a rescue floor on a floor which is above the relevant transit floor in close vicinity thereto, each elevator can perform rescue activities by reciprocal operations between the rescue floor and safe floors.

In a case where the floor on which the fire broke out is a top zone, a rescue floor is set on a transit floor below the top zone as the rescue floor for an elevator which serves the top zone. In a case where the floor on which the fire broke out is not a top zone and the floor on which the fire broke out is above a zone including the floor, a rescue floor is set on a transit floor above the relevant zone as the rescue floor for an elevator which serves the relevant zone. And in other cases, a rescue floor is set on a transit floor below the relevant zone. Thus, present invention has the advantage that the number of elevators which the people who are present in a zone of the building where the degree of risk is highest due to the fire can ride increases, with the result that evacuation can be swiftly performed.

The present invention has the advantage that in a case where the floor on which the fire broke out is a transit floor between zones or a floor directly under the transit floor, safe evacuation operations can be performed by excluding the transit floor from candidates for rescue floors.

The present invention has the advantage that in a case where the floor on which the fire broke out is a transit floor between zones or a floor directly under the transit floor and the transit floor has been excluded from candidates for rescue floors and when there is another transit floor capable of being served, rescue operations can be performed by using all elevators capable of being operated by setting a rescue floor on the relevant transit floor.

DESCRIPTION OF SYMBOLS

1 Evacuation plan preparation device
1A Communication unit
1B Evacuation operation propriety judging unit
1C Rescue floor setting unit
1D Rescue operation instruction unit
1E Fire-zone rescue floor setting unit
1F Nonfire-zone rescue floor setting unit

2 Disaster prevention controller
3 Fire detector
4 Emergency broadcaster
5 Elevator group controller

BEST MODE FOR CARRYING OUT THE INVENTION

The present invention will be described in further detail in accordance with the accompanying drawings.

EMBODIMENT 1

Figure 1:
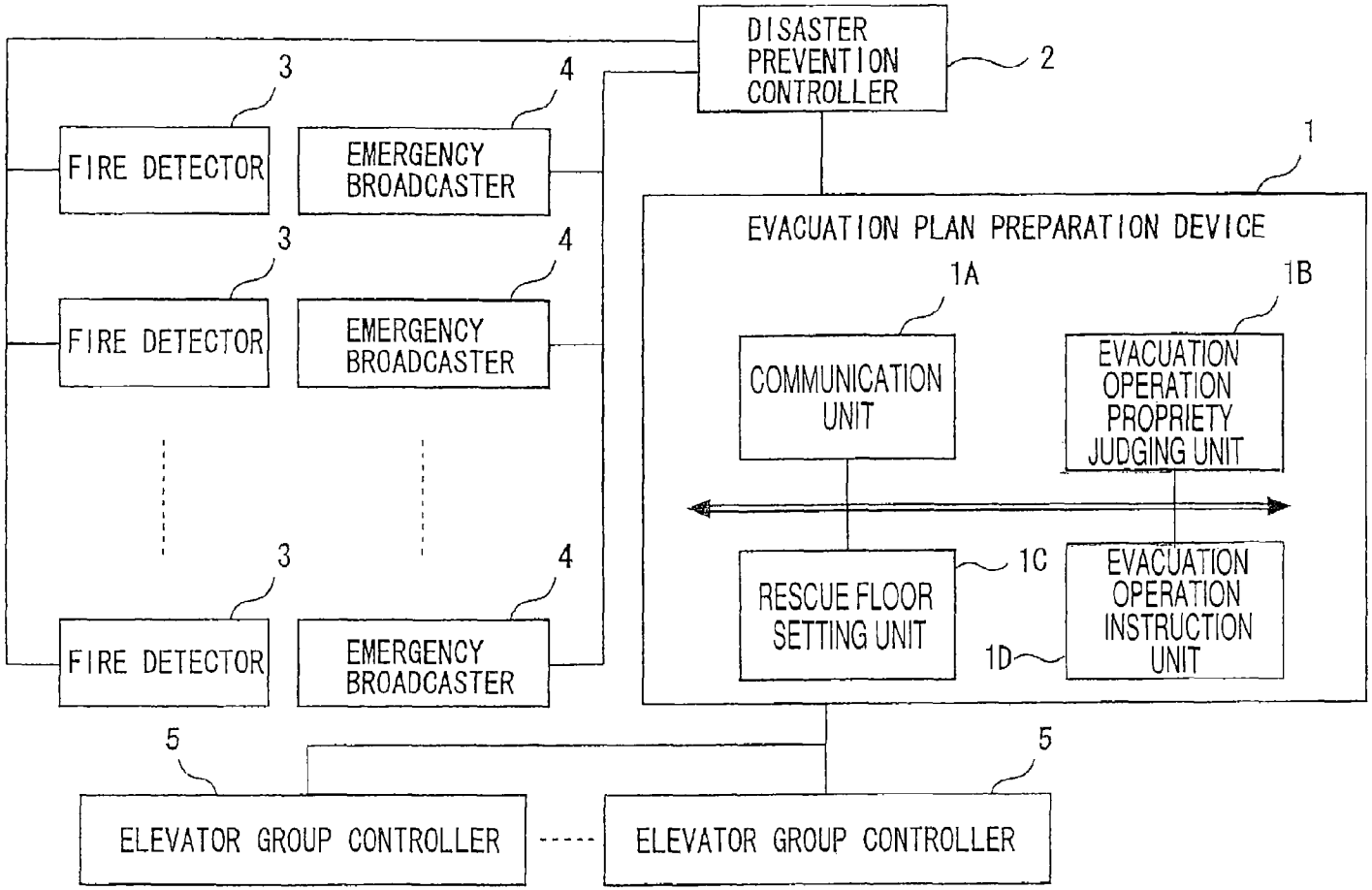
FIG. 1 is a block diagram which shows an example of the functional general configuration of a fire evacuation operation system for group-controlled elevators in Embodiment 1 of the present invention.

Hereinafter, a fire evacuation operation system for group-controlled elevators in Embodiment 1 of the present invention will be described. FIG. 1 is a block diagram which shows an example of the functional general configuration of a fire evacuation operation system for group-controlled elevators in Embodiment 1 of the present invention. In FIG. 1, the reference numeral 1 denotes an evacuation plan preparation device which prepares an elevator evacuation plan and gives instructions, the reference numeral 2 denotes a disaster prevention controller which manages and controls the disaster prevention equipment of the whole building, the reference numeral 3 denotes a fire detector installed on each floor, and reference numeral 4 denotes an emergency broadcaster also installed on each floor, which makes announcements and the like about evacuation and guidance in an emergency. The reference numeral 5 denotes an elevator group controller which manages and controls elevator groups.

The following units 1A to 1D are included in the evacuation plan preparation device 1 of FIG. 1. Each of the units 1A to 1D is constituted by software on a microcomputer. The reference numeral 1A denotes a communication unit which performs information communication with each elevator group controller 5 and the like, the reference numeral 1B denotes an evacuation operation propriety judging unit that judges whether the operation of an elevator which serves each zone is possible, the reference numeral 1C denotes a rescue floor setting unit that sets a rescue floor when an evacuation operation is performed according to the position of a floor on which the fire broke out, and the reference numeral 1D denotes an evacuation operation instruction unit that gives evacuation operation instructions to each elevator group controller 5.

Figure 2:
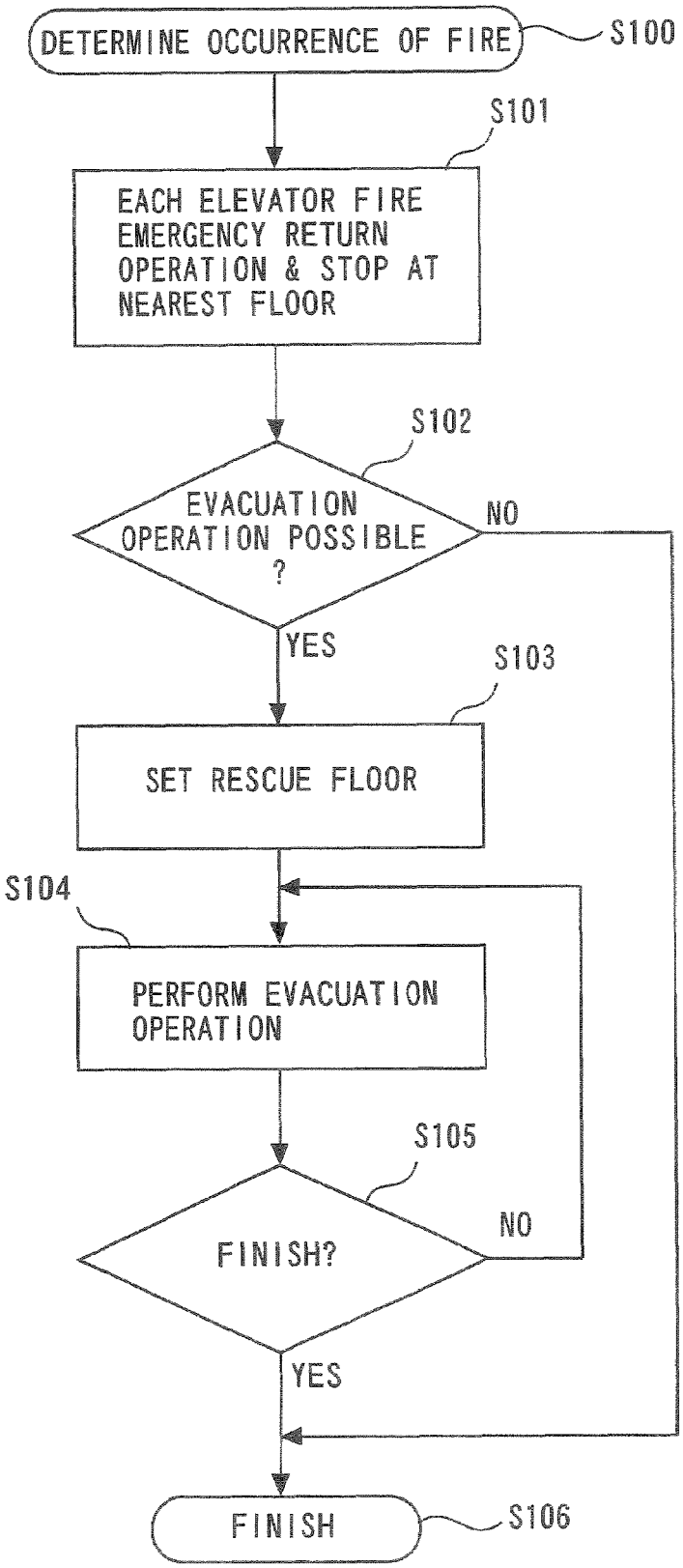
FIG. 2 is a flowchart which shows an outline of operations in the fire evacuation operation system for group-controlled elevators in Embodiment 1 of the present invention.
Figure 3:
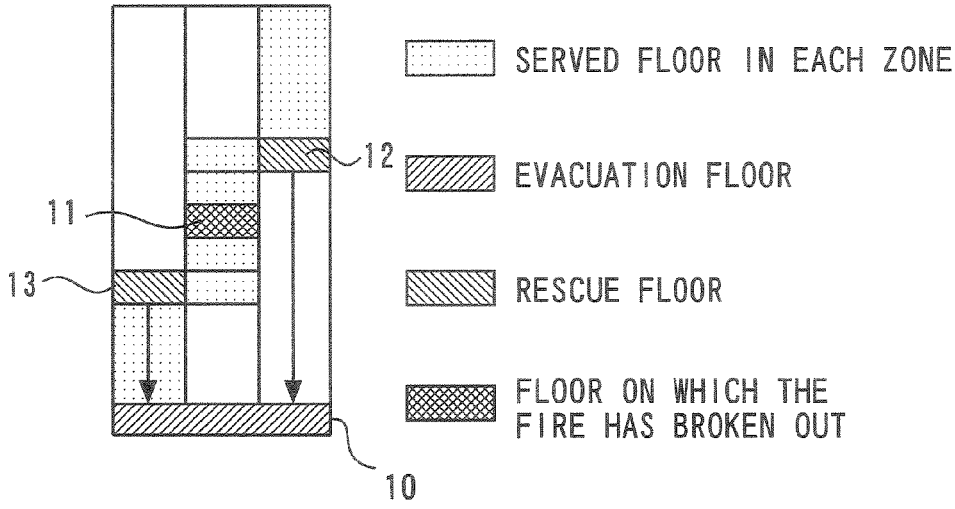
FIG. 3 is an explanatory diagram to explain an example of a rescue floor setting operation in the fire evacuation operation system for group-controlled elevators in Embodiment 1 of the present invention.
Figure 4:
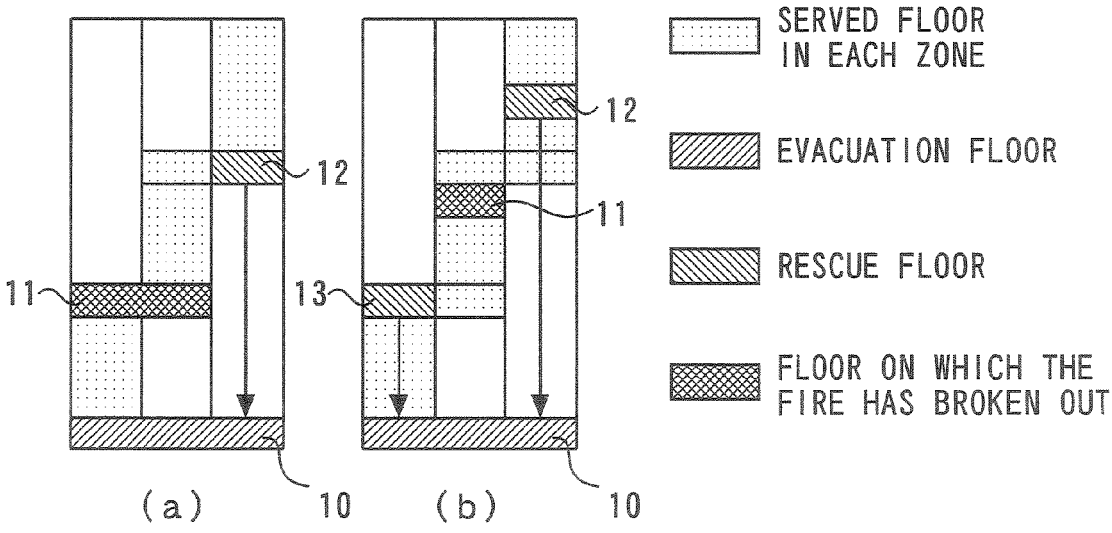
FIGS. 4(*a*) and 4(*b*) are each an explanatory diagram to explain another example of a rescue floor setting operation in the fire evacuation operation system for group-controlled elevators in Embodiment 1 of the present invention.

Next, operations in Embodiment 1 of the present invention will be described by using FIGS. 2 to 4. FIG. 2 is a flowchart which shows an outline of operations in Embodiment 1 of the present invention. FIGS. 3 and 4 are explanatory diagrams to explain rescue floor setting operations in Embodiment 1 of the present invention.

First, when a fire is detected by the fire detector 3 of FIG. 1 and the occurrence of the fire is determined, in Step S100 of FIG. 2, the information on the determination of the occurrence of the fire is inputted from the disaster prevention controller 2 of FIG. 1 to the evacuation plan preparation device 1. After that, in Step S101, the operation of each elevator is shifted to an operation called a fire emergency return operation. In this fire emergency return operation, traveling elevators stop at their nearest floor and let passengers to get out of the elevators by opening the doors.

After that, in Step S102, the evacuation operation propriety judging unit 1B judges whether an evacuation operation can be performed for elevator groups which serve each zone.

In this step, basically, it is judged that an evacuation operation is improper for an elevator group which serves a floor on which the fire broke out 11 and the operation of this elevator group is suspended. The flow of the operations then proceeds to Step S106. Also, it is judged that an evacuation operation is possible for an elevator group which serves a floor not including the floor on which the fire broke out 11, and the flow of the operations proceeds to Step S103.

Next, in Step S103, for each elevator group for which it was judged in Step 102 above that an evacuation operation is possible, a rescue floor is set according to the occurrence position of the fire. Hereinafter, the setting of a rescue floor will be described by using FIGS. 3 and 4.

FIG. 3 shows an example of a building in which elevators which separately serve the three zones of low, middle and high zones are used. That is, in this example, a high-zone elevator (the right-hand elevator of FIG. 3) serves an entrance floor and each floor of the high zone, a middle-zone elevator (the elevator at the center of FIG. 3) serves the entrance floor and each floor of the middle zone, and a low-zone elevator (the left-hand elevator of FIG. 3) serves the entrance floor and each floor of the low zone. Incidentally, the entrance floor becomes an evacuation floor 10 in the event of a fire.

As shown in the example of FIG. 3, a description will be given of a case where a fire broke out on a floor included in the middle zone.

In the example of FIG. 3, first, it is judged in Step S102 that the operation of the elevator for the middle zone including the floor on which the fire broke out 11 should be suspended. For the high-zone elevator, the transit floor of the high zone/middle zone is set as a rescue floor 12. For the low-zone elevator, the transit floor of the middle zone/low zone is set as a rescue floor 13.

As a result of this, the people who are present in the high zone move by stairs to the rescue floor 12, which is the transit floor of the high zone/middle zone, and after that they ride the high-zone elevator and can move to the entrance floor, which is the evacuation floor 10. The people who are present in the middle zone move by stairs to the rescue floor 13, which is the transit floor of the middle zone/low zone and after that they ride the low-zone elevator and move to the entrance floor, which is the evacuation floor 10. Incidentally, the people who are present in the low zone perform evacuation by stairs.

In this manner, basically, for a zone above the floor on which the fire broke out 11, a transit floor between the relevant zone and a zone below the relevant zone is set as the rescue floor 12. For a zone below the floor on which the fire broke out 11, a transit floor between the relevant zone and a zone above the relevant zone is set as the rescue floor 13.

As the general psychology of human beings, the people who are present in a building move downward in the event of a disaster, such as a fire. Therefore, if transit floors as described above are set, all the people who are present in the building except the people on the bottom floor can ride an elevator by moving by stairs to a transit floor below their own zones. The stair movement distance of the people who are present in each zone is substantially fair and equitable and it is unnecessary for only people on specific floors to move by stairs over a long distance. Furthermore, evacuation can be completed more swiftly than in a case where all people move only by stairs.

Next, with reference to FIG. 4, a description will be given of rescue floor setting in a case where a fire broke out on a transition floor or on a floor below a transition floor in the close vicinity thereto.

FIG. 4(*a*) shows a case where a fire broke out on a transit floor of the middle zone/low zone. In this case, because the fire broke out on the floor which are served by the middle-zone and low-zone elevators, it is judged in Step S102 that for both the middle-zone and low-zone elevators, an evacuation operation is improper, and the operation of the middle-zone and low-zone elevators is suspended. Therefore, the people who are present in the middle zone and low zone perform evacuation by stairs. For the high-zone elevator, as described above, the rescue floor 12 is set on the transit floor of the high zone/middle zone and the people who are present in the high zone can evacuate by the elevator from this rescue floor 12.

Incidentally, though not illustrated, in a case where a fire broke out on a floor jointly served by each elevator, such as the entrance floor, it is judged in Step S102 that the operation of all elevators should be suspended.

FIG. 4(*b*) shows a case where a fire broke out on a floor directly under a transit floor of the high zone/middle zone. In this case, because the fire broke out on the floor which is served by the middle-zone elevator, it is judged in Step S102 that for the middle-zone elevator, an evacuation operation is improper, and the operation of the middle-zone elevator is suspended. Also, it is judged in Step S102 that for the high-zone elevator, an evacuation operation is possible. However, when a fire broke out on the floor directly under a transit floor, the fire may sometimes spread depending on the development of the fire. For this reason, in consideration of a safety allowance, the rescue floor 12 for the high zone is shifted to a floor above the transit floor. For example, the following method is conceivable as this method of shifting.

In a case where the floor on which the fire broke out 11 is a transit floor−one story, the rescue floor is set on the transit floor+two stories. And in a case where the floor on which the fire broke out is a transit floor−two stories, the rescue floor is set on the transit floor+one story.

That is, X (story) is set as a safety parameter and in a case where the fire broke out on a transit floor−one story to the transit floor−X story, the rescue floor is set on the floor on which the fire broke out+X+one story. The above-described example is a case where X=2. The value of this X may be appropriately set according to the construction of the building.

When the rescue floor is set in Step S103 as described above, the flow of the operations proceeds to Step S104, where evacuation using elevators is performed.

Elevators capable of an evacuation operation perform reciprocal operations between the rescue floors 12, 13 which were set and the evacuation floor 10 (usually, the entrance floor) and are engaged in the evacuation and rescue of the people who are present in the building. From the emergency broadcaster 4 installed on each floor, there are provided information and guidance to the people who are present in the building as to whether elevator evacuation is possible and from which floor one can ride an elevator.

The above-described evacuation operation in Step S104 is continued until it is judged to be finished at Step S105. Conceivable conditions for this judgment on finish are, for example, as follows:

(i) A case where the finish of the operation is judged by the judgment by human beings, such as disaster prevention personnel and fire brigades, and the finish of the operation is inputted.

(ii) A case where the safety of elevator operations is endangered by the progress of the fire, water immersion due to firefighting activities, and the like.

(iii) A case where riding an elevator at the rescue floor ceases and it is judged that the evacuation has been completed.

Automatic judgment is possible by manual input for (i) above and by sensors of the equipment related to the elevators, such as getting-on/off sensors for (ii) and (iii). Incidentally, the conditions for the judgment on the finish are not limited to those described above. For example, the operation may be finished in a case where it becomes difficult to ensure safety for some reason and in a case where the conditions, on the basis of which the evacuation can be judged to have been finished, are satisfied.

Steps S102 to S104 above are carried out for each elevator group in charge of each zone.

EMBODIMENT 2

Figure 5:
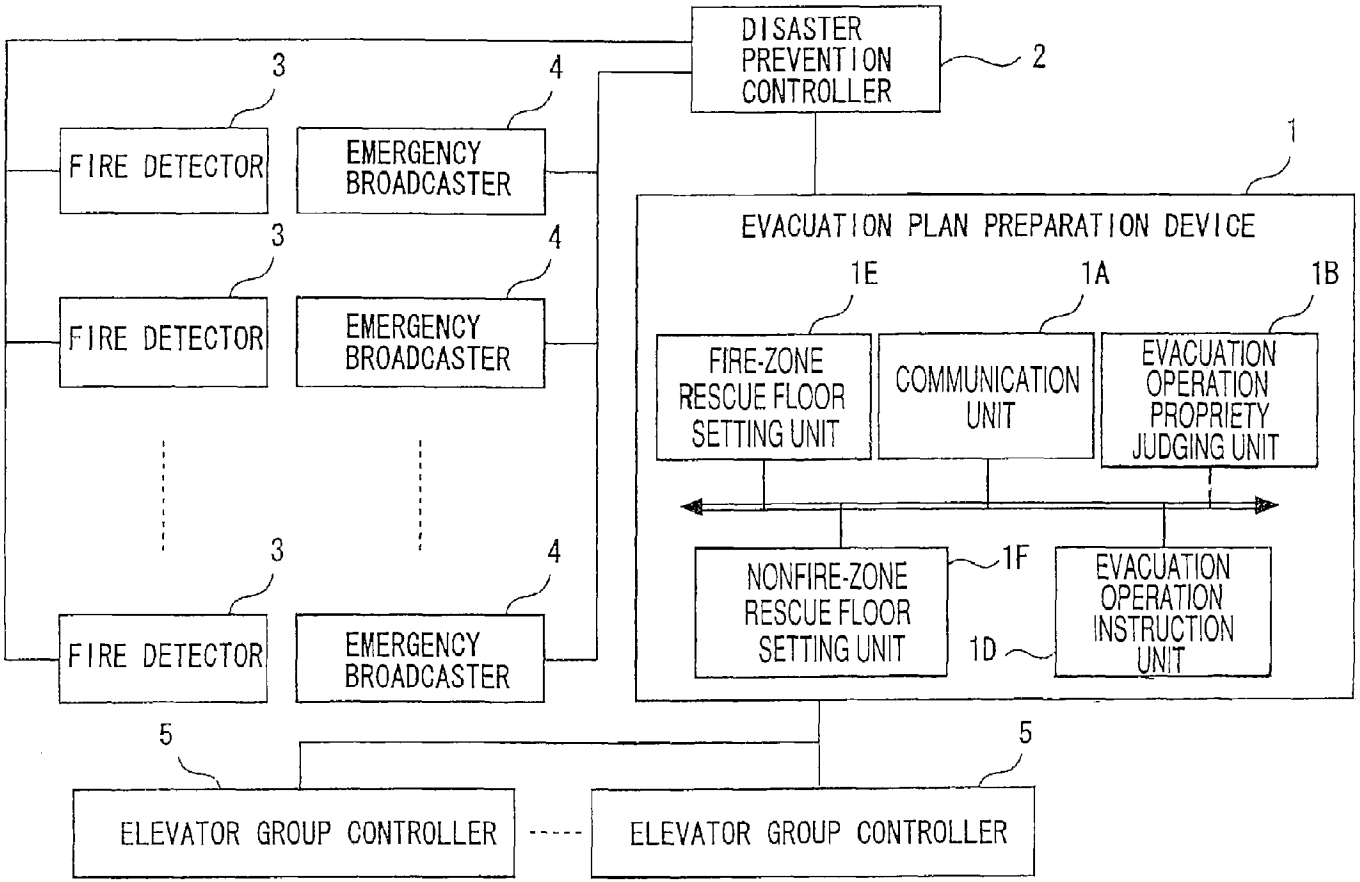
FIG. 5 is a block diagram which shows an example of the functional general configuration of a fire evacuation operation system for group-controlled elevators in Embodiment 2 of the present invention.

Hereinafter, a fire evacuation operation system for group-controlled elevators in Embodiment 2 of the present invention will be described. FIG. 5 is a block diagram which shows an example of the functional general configuration of a fire evacuation operation system for group-controlled elevators in Embodiment 2 of the present invention. Because in FIG. 5 the same reference numerals as in FIG. 1 refer to the same parts as in FIG. 1, descriptions of these parts are omitted and only parts different from FIG. 1 are described. The reference numeral 1E denotes a fire-zone rescue floor setting unit that sets a rescue floor according to the position of a floor on which a fire broke out in a case where an evacuation operation is performed by an elevator which serves a zone including the floor on which the fire broke out, and the reference numeral 1F denotes nonfire-zone rescue floor setting means which sets a rescue floor in a case where an evacuation operation is performed by an elevator which serves a zone not including the floor on which the fire broke out.

Figure 6:
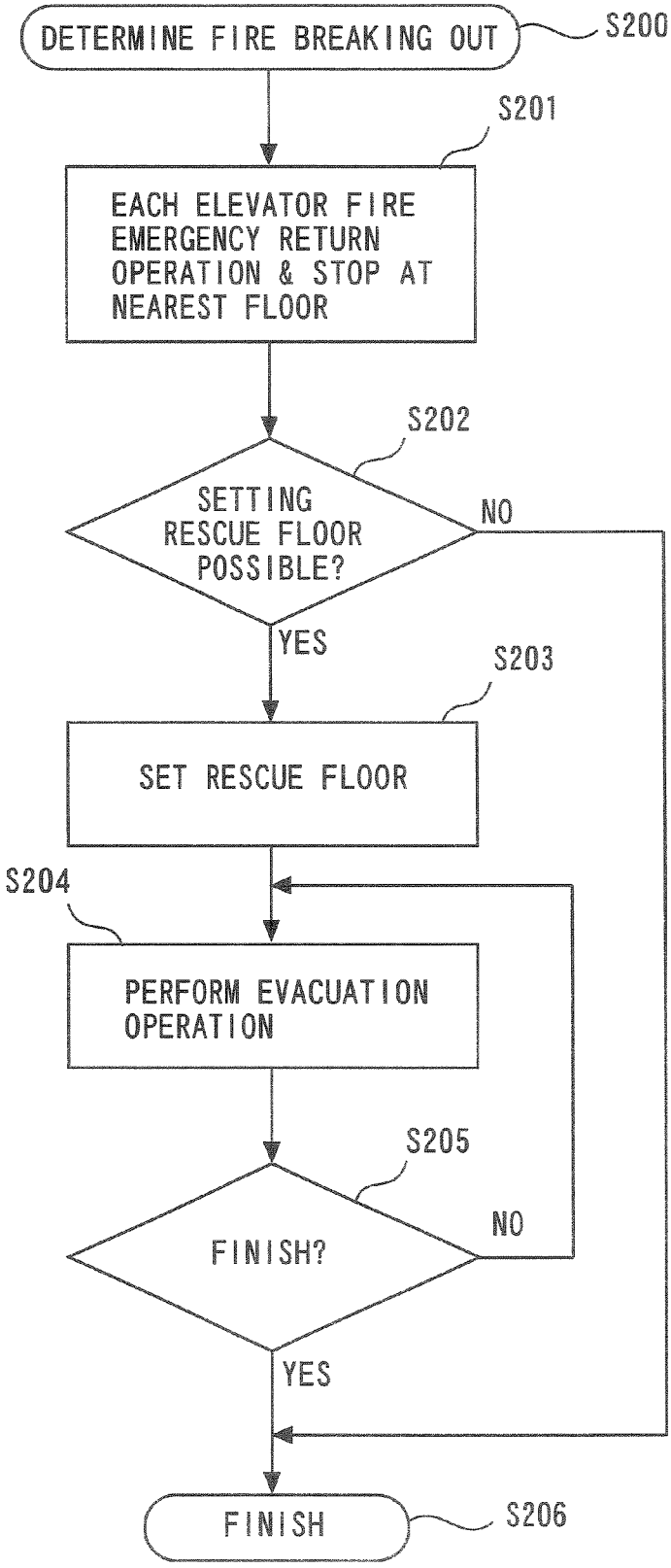
FIG. 6 is a flowchart which shows an outline of operations in the fire evacuation operation system for group-controlled elevators in Embodiment 2 of the present invention.
Figure 7:
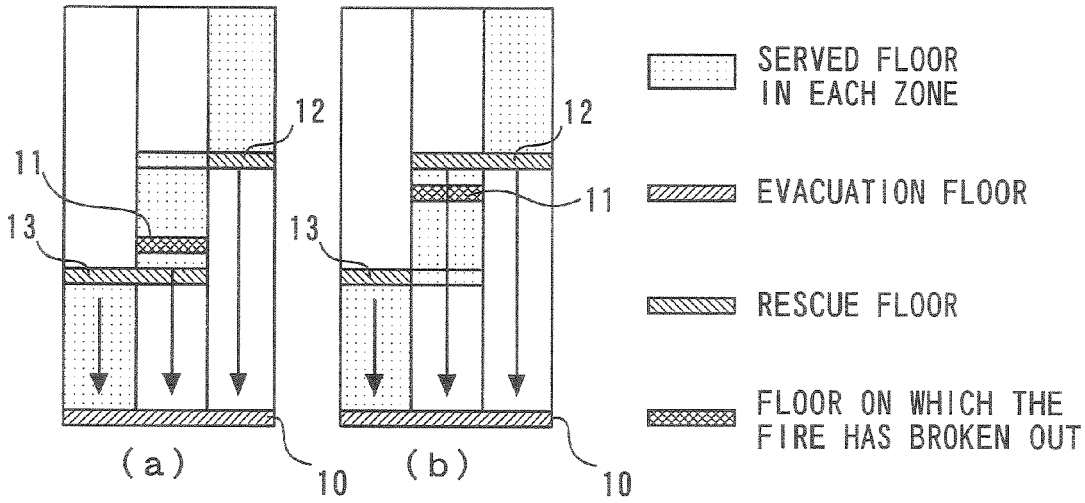
FIGS. 7(*a*) and 7(*b*) are each an explanatory diagram to explain an example of a rescue floor setting operation in the fire evacuation operation system for group-controlled elevators in Embodiment 2 of the present invention.
Figure 8:
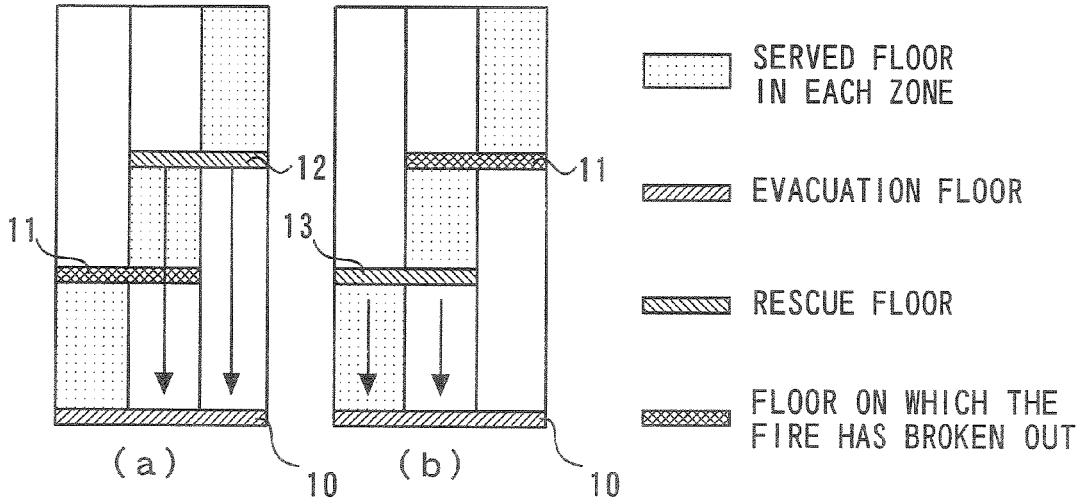
FIGS. 8(*a*) and 8(*b*) are each an explanatory diagram to explain another example of a rescue floor setting operation in the fire evacuation operation system for group-controlled elevators in Embodiment 2 of the present invention.

Next, operations in Embodiment 2 of the present invention will be described by using FIGS. 6 to 8. FIG. 6 is a flowchart which shows an outline of operations in Embodiment 2 of the present invention. FIGS. 7 and 8 are explanatory diagrams to explain rescue floor setting operations in Embodiment 2 of the present invention.

First, when a fire is detected by the fire detector 3 of FIG. 5 and the occurrence of the fire is determined, in Step S200 of FIG. 6, the information on the determination of the occurrence of the fire is inputted from the disaster prevention controller 2 of FIG. 5 to the evacuation plan preparation device 1. After that, in Step S201, the operation of each elevator is shifted to an operation called a fire emergency return operation. In this fire emergency return operation, traveling elevators stop at their nearest floor and let passengers to get out of the elevators by opening the doors.

After that, in Step S202, it is judged whether an evacuation floor can be set for elevator groups which serve each zone. In this Embodiment 2, as will be described later in Step S203, basically, a rescue floor is set for a transit floor of each zone. However, a fire may sometimes break out on a transit floor or a floor directly under this transit floor. In this case, when there is another transit floor capable of being served, a rescue floor is set on this transit floor. However, when there is no other transit floor, it is judged that it is impossible to set a rescue floor for the relevant zone and the flow of the operations proceeds to Step S206, where the operation of the elevator is suspended.

Incidentally, when a fire broke out on a floor at which each elevator lets passengers to get off jointly, such as an evacuation floor (usually, the entrance floor), it is judged in Step S202 that the operation of all elevators is improper and the flow of the operations proceed to Step S206, where the operation of the elevators is suspended.

When a rescue floor can be set in cases other than the above-described cases, the flow of the operations proceeds to Step S203.

Next, in Step S203, for each elevator group for which in Step S202 above an evacuation operation was judged to be possible, a rescue floor is set according to the position of the occurrence of the fire. Hereinafter, this setting of a rescue floor will be described by using FIGS. 7(*a*) and 7(*b*) and FIGS. 8(*a*) and 8(*b*).

FIGS. 7(*a*) and 7(*b*) show an example of a building in which elevators which separately serve the three zones of low, middle and high zones are used. That is, in this example, a high-zone elevator (the right-hand elevator of FIG. 7) serves an entrance floor and each floor of the high zone, a middle-zone elevator (the elevator at the center of FIG. 7) serves the entrance floor and each floor of the middle zone, and a low-zone elevator (the left-hand elevator of FIG. 7) serves the entrance floor and each floor of the low zone. Incidentally, the entrance floor becomes an evacuation floor 10 in the event of a fire.

First, as shown in the example of FIG. 7(*a*), a description will be given of a case where a fire broke out on a floor in a somewhat lower floor of the middle zone. The reference numeral 11 denotes a floor on which a fire broke out.

In the example of FIG. 7(*a*), floors which are considered most dangerous due to the occurrence of the fire are floors in the middle zone. Therefore, in this case, the top priority should be given to the people who are present in the middle zone. For this reason, for the middle-zone elevator, a rescue floor 13 is set on a transit floor of the middle zone/low zone. For the low-zone elevator which is present below the middle zone, a rescue floor 13 is set on a transit floor above this low zone. As a result, in the same manner as with the middle-zone elevator, the rescue floor 13 is set on the transit floor of the middle zone/low zone. Because of this, the people who are present in the middle zone move to the transit floor of the middle zone/low zone by stairs and after that they can swiftly move to the evacuation floor (the entrance floor) by using both the middle-zone elevator and the low-zone elevator.

For the high-zone elevator, a transit floor of the high zone/middle zone which is below this high zone is set as a rescue floor 12. The people who are present in the high zone move to the transit floor of the high zone/middle zone by stairs and after that they can swiftly move to the evacuation floor (the entrance floor) by using the high-zone elevator. Incidentally, the people who are present in the low zone perform evacuation by stairs.

Next, the case shown in FIG. 7(*b*) will be described. This is a case where a fire broke out in a somewhat upper floor of the middle zone, and the reference numeral 11 denotes a floor on which the fire broke out. In this case, in consideration of spread of the fire, it is judged that the dangerousness is higher in the high zone than in the middle. For this reason, priority is given to the evacuation of the people who are present in the high zone compared to the people in the middle zone, and for the middle-zone elevator, a rescue floor 12 is set on a transit floor of the high zone/middle zone. On the other hand, for the high-zone elevator and the low-zone elevator, in the same manner as in the case of FIG. 7(*a*), a rescue floor 12 and a rescue floor 13 are set respectively on a transit floor of the top zone/middle zone and on a transit floor of the middle zone/low zone. As a result of this, the people who are present in the high zone move to the transit floor of the high zone/middle zone by stairs and after that they can swiftly perform evacuation by using both the high-zone elevator and the middle-zone elevator. The people who are present in the middle zone perform evacuation by the low-zone elevator and the people who are present in the low zone perform evacuation by stairs.

In this manner, basically, for a zone including the floor on which the fire broke out 11, the rescue floors 12, 13 are set on either an upper transit floor or a lower transit floor according to the position of the occurrence of the fire. For a zone above the floor on which the fire broke out 11, a transit floor between the relevant zone and a zone below the relevant floor is set as the rescue floor 12, and for a zone below the floor on which the fire broke out 11, a transit floor between the relevant floor and a floor above the relevant floor is set as the rescue floor 13.

If this method is adopted, the people who are present in a zone to which the priority of evacuation should be given in the case of a fire can perform evacuation by using many elevators compared to the people in other zones.

Incidentally, as shown in FIGS. 7(*a*) and 7(*b*), as to the setting of a rescue floor on which of an upper transit floor and a lower transit floor for an elevator of a zone including the floor on which the fire broke out 11, X (story) is set as a parameter and in a case where the fire broke out on an upper transit floor–two stories to the transit floor–X story, the rescue floor is set on the upper transit floor. The value of this X may be appropriately set according to the construction of the building.

Next, with reference to FIGS. 8(*a*) and 8(*b*), the setting of a rescue floor will be described in a case where a fire broke out on a transit floor or a floor directly below the transit floor.

FIG. 8(*a*) shows a case where a fire broke out on a transit floor of the middle zone/low zone. The reference numeral 11 denotes a floor on which the fire broke out. In this case, the fire broke out on the transit floor served by the low-zone elevator and there is no other transit floor to be set as a rescue floor. In Step S202, therefore, it is judged for the low-zone elevator, the setting of a rescue floor is improper and the operation of the low-zone elevator is suspended. Therefore, the people who are present in the middle zone and the low zone perform evacuation by stairs.

Because for the middle-zone elevator, it is improper to set a rescue floor on the transit floor of the middle zone/low zone, the rescue floor 12 is set on the transit floor of the high zone/middle zone in place of the transit floor of the middle zone/low zone. Incidentally, for the high-zone elevator, as described above, the rescue floor 12 is set on the transit floor of the high zone/middle zone. Therefore, the people who are present in zones above the rescue floor 12, which is the transit floor of the high zone/middle zone can perform evacuation by using both the high-zone elevator and the middle-zone elevator.

FIG. 8(*b*) shows a case where a fire broke outs on a transit floor of the high zone/middle zone. The reference numeral 11 denotes a floor on which a fire broke out. In this case, the fire broke out on the transit floor served by the high-zone elevator and there is no other transit floor on which a rescue floor is to be set. Therefore, in Step S202 it is judged that for the high-zone elevator, the setting of a rescue floor is improper and the operation of the high-zone elevator is suspended. Because for the middle-zone elevator, the setting of a rescue floor on the transit floor of the high zone/middle zone is improper, a rescue floor 13 is set on the transit floor of the middle zone/low zone in place of the transit floor of the high zone/middle zone. Therefore, the people who are present in the high zone and the middle zone move to the transit floor of the middle zone/low zone by stairs and after that they perform evacuation by using both the middle-zone elevator and the low-zone elevator.

Incidentally, though not illustrated, in the event of a fire on the evacuation floor (the entrance floor), it is judged in Step 202 the operation of all elevators is suspended.

When the rescue floor has been set in Step S203 as described above, the flow of the operations proceeds to Step S204 and evacuation by use of elevators is performed.

Elevators capable of a rescue operation perform reciprocal operations between the rescue floors which were set and the evacuation floor (usually, the entrance floor) and are engaged in the evacuation and rescue of the people who are present in the building. From the emergency broadcaster 4 installed on each floor, there are provided information and guidance as to whether elevator evacuation is possible and from which floor one can ride an elevator.

The above-described evacuation operation in Step S204 is continued until it is judged to be finished at Step S205. Conceivable conditions for this judgment on finish are, for example, as follows:

(i) A case where the finish of the operation is judged by the judgment by human beings, such as disaster prevention personnel and fire brigades, and the finish of the operation is inputted.

(ii) A case where the safety of elevator operations is endangered by the progress of the fire, water immersion due to firefighting activities, and the like.

(iii) A case where riding an elevator at the rescue floor ceases and it is judged that the evacuation has been completed.

Automatic judgment is possible by manual input for (i) above and by sensors of the equipment related to the elevators such as getting-on/off sensors for (ii) and (iii). Incidentally, the conditions for the judgment on the finish are not limited to those described above. The operation is finished in a case where it becomes difficult to ensure safety for some reason and in a case where the conditions, on the basis of which the evacuation can be judged to have been finished, are satisfied.

Steps S202 to S206 above are carried out for each elevator group in charge of each zone.

INDUSTRIAL APPLICABILITY

As described above, with attention paid to the fact that owing to improvements in fire protection partitions of buildings and other techniques or the like, floors except a floor on which a fire broke out and floors above this floor in close vicinity thereto are little affected by the fire, a fire evacuation operation system for group-controlled elevators of the present invention permits the evacuation of a large number of people in a short time by positively providing safe elevators as evacuation means according to the position of the floor on which the fire broke out.

The invention claimed is:

1. A fire evacuation operation system for group-controlled elevators, in which floors to be served are divided into multiple service zones, multiple elevators which serve each of the service zones from an entrance floor are provided, the system comprising:

an evacuation plan preparation unit configured to cause each of the elevators to stop at a nearest floor thereof when a fire detector installed on each floor of a building detects that a fire had broken out;

an evacuation operation propriety judging unit, including a processor, configured to judge, in the event of a fire, an evacuation operation is improper for an elevator which serves a zone including a floor on which the fire broke out and causes the elevator to stop at a nearest floor thereof and then to suspend an operation thereof, and configured to judge that an evacuation operation is possible for an elevator which serves a zone not including the floor on which the fire broke out;

a rescue floor setting unit configured to set a rescue floor, according to the floor on which the fire broke out, for the elevator for which the evacuation operation propriety judging unit has judged that an evacuation operation is possible; and an evacuation operation instruction unit configured to cause the elevator to reciprocate between the entrance floor, which becomes the evacuation floor, and the rescue floor.

2. The fire evacuation operation system for group-controlled elevators according to claim 1, wherein for a second zone above a first zone, the first zone including the floor on which the fire broke out, the rescue floor setting unit sets a rescue floor on a transit floor between the second zone and a zone which is by one story lower than the second zone, and for a third zone below the first zone, the first zone including the floor on which the fire broke out, the rescue floor setting unit sets a rescue floor on a transit floor between the third zone and a zone which is by one story higher than the third zone.

3. The fire evacuation operation system for group-controlled elevators according to claim 1, wherein in a case where the floor on which the fire broke out is a transit floor between zones, the evacuation operation propriety judging unit suspends the operation of elevators in zones which share the relevant transit floor.

4. The fire evacuation operation system for group-controlled elevators according to claim 1, wherein in a case where the floor on which the fire broke out is a floor which is below a transit floor between zones in close vicinity thereto, the rescue floor setting unit sets a rescue floor on a floor which is above the relevant transit floor in close vicinity thereto.

5. A fire evacuation operation system for group-controlled elevators, in which floors to be served are divided into multiple service zones, multiple elevators which serve each of the service zones from an entrance floor are provided, and each of the elevators is caused to stop at a nearest floor thereof when a fire detector installed on each floor of a building detected that a fire had broken out, the system comprising:

a fire-zone rescue floor setting unit, including a processor, configured to cause, in the event of a fire, all elevators to stop at a nearest floor thereof and thereafter configured to set a rescue floor, for each elevator in a zone including the floor on which the fire broke out, on a transit floor above the zone served by the relevant elevator or a transit floor below the zone served by the relevant elevator according to the position of the floor on which the fire broke out;

a nonfire-zone rescue floor setting unit configured to set, for a zone above the zone including the floor on which the fire broke out, a rescue floor on a transit floor between the relevant zone and a zone which is by one story lower than the relevant floor; and configured to set, for a zone below the zone including the floor on which the fire broke out, a rescue floor on a transit floor between the relevant zone and a zone which is by one story higher than the relevant floor; and an evacuation operation instruction unit configured to cause all of the elevators to reciprocate between an entrance floor, which becomes the evacuation floor, and the rescue floor.

6. The fire evacuation operation system for group-controlled elevators according to claim 5, wherein in a case where the floor on which the fire broke out is a top zone, the fire-zone rescue floor setting unit sets a rescue floor on a transit floor below the top zone as the rescue floor for an elevator which serves the top zone, wherein in a case where the floor on which the fire broke out is not a top zone and the floor on which the fire broke out is above a zone including the floor, the fire-zone rescue floor setting unit sets a rescue floor on a transit floor above the relevant zone as the rescue floor for an elevator which serves the relevant zone, and wherein in other cases, the fire-zone rescue floor setting unit sets a rescue floor on a transit floor below the relevant zone.

7. The fire evacuation operation system for group-controlled elevators according to claim 5, wherein in a case where the floor on which the fire broke out is a transit floor between zones or a floor directly under the transit floor, the fire-zone rescue floor setting unit excludes the transit floor from candidates for rescue floors.

8. The fire evacuation operation system for group-controlled elevators according to claim 7, wherein in a case where the floor on which the fire broke out is a transit floor between zones or a floor directly below the transit floor and the transit floor has been excluded from candidates for rescue floors and when there is another transit floor capable of being served, the fire-zone rescue floor setting unit sets a rescue floor on the relevant transit floor.

9. The fire evacuation operation system for group-controlled elevators according to claim 1, wherein in a case where the floor on which the fire broke out is jointly served by each elevator, the evacuation operation propriety judging unit suspends the operation of all elevators.

10. The fire evacuation operation system for group-controlled elevators according to claim 1, wherein the rescue floor setting unit sets the rescue floor as a transit floor that is serviced by elevators in different zones.

* * * * *